United States Patent [19]

Ihara

[11] Patent Number: 4,867,459

[45] Date of Patent: Sep. 19, 1989

[54] GOLF BALLS

[75] Inventor: Keisuke Ihara, Tokyo, Japan

[73] Assignee: Bridgestone Corporation, Tokyo, Japan

[21] Appl. No.: 118,690

[22] Filed: Nov. 9, 1987

[30] Foreign Application Priority Data

Nov. 7, 1986 [JP] Japan ..... 61-264102

[51] Int. Cl.[4] ..... A63B 37/12

[52] U.S. Cl. ..... 273/232; 273/213

[58] Field of Search ..... 273/232, 213, 183 C, 273/235 R; 40/327

[56] References Cited

U.S. PATENT DOCUMENTS 4,653,758 3/1987 Solheim ..... 273/232

FOREIGN PATENT DOCUMENTS 2157959 11/1985 United Kingdom ..... 273/232

*Primary Examiner*—George J. Marlo

*Attorney, Agent, or Firm*—Sughrue, Mion, Zinn, Macpeak & Seas

[57] ABSTRACT

A golf ball has a spherical surface inscribed or circumscribed with a regular icosahedron, and dimples formed in the spherical surface. This golf ball has at least 16 symmetrical axes or great circles and provides accurate flying directionality and driving distance. The invention provides in various embodiments 21, 25 or 31 great circles 22, 23, 24 and 25 that do not intersect the dimples on the surface.

4 Claims, 5 Drawing Sheets

GOLF BALLS

BACKGROUND OF THE INVENTION

1. Field of the Invention

This invention relates to golf balls having improved flying directionality and driving performances, and more particularly to golf balls each having at least 16 symmetrical axes and containing plural dimples equally and constantly disposed on the outer surface thereof so as not to cross with a great circle corresponding to respective symmetrical axis.

2. Related Art Statement

When designing the arrangement, size, shape and the like of dimples on the spherical surface of the golf ball, it is generally practised to take a regular dodecahedron or a regular icosahedron as a basic shape as disclosed, for example, in British Patent No. 377,354, Japanese Patent laid open No. 49-52,029 and U.S. Pat. Nos. 4,142,727 and 4,560,168. In these conventional techniques, considering a spherical triangle obtained by projecting each of equilateral triangles constituting the regular icosahedron onto a spherical surface inscribed or circumscribed with the regular icosahedron, a great circle is formed about a line segment connecting each vertex or center of the spherical triangle to the center of the sphere as a center axis, while the arrangement, size, shape and so on of dimples in each of the spherical triangles are determined in connection with the great circle passing through the respective spherical triangle.

For instance, if it is intended to form the great circle about a line segment connecting each vertex ($P_1$) of the spherical triangle to the center of the sphere as a center axis, six great circles or six symmetrical axes corresponding thereto are formed as shown by dotted lines in FIG. 5*a*. If; it is intended to form the great circle about a line segment connecting the center ($P_2$) of the spherical triangle to the center of the sphere as a center axis, ten great circles or ten symmetrical axes corresponding thereto are formed as shown by dotted lines in FIG. 5*b*. In FIGS. 5*a* and 5*b*, one line of these dotted lines is used as a parting line in the manufacture of the golf ball.

In general, the golf ball is always necessary to have a parting line in the manufacture of the ball. In order to enhance the aerodynamic isotropy of the spherical face of the ball considering such a restriction, it is desirable that the number of particular great circles regularly existing in the ball is made as large as possible to substantially equalize the lift and drag of the flying golf ball with translational and rotational motions at both sides thereof with respect to the respective great circle irrespective of the striking position and to enhance a probability of rotating the golf ball in the same direction as in the extending direction of the great circle. However, when the great circle is formed about the line segment connecting each vertex or center of the spherical triangle to the center of the sphere as in the conventional technique, the total number of great circles is 10 at maximum, so that it is substantially impossible to form more than 10 great circles. Therefore, the aerodynamic isotropy of the conventional golf ball is low and consequently the flying directionality, driving distance and the like are frequently changed in accordance with the striking position on the golf ball.

SUMMARY OF THE INVENTION

It is, therfore, an object of the invention to advantageously solve the aforementioned problems of the conventional techniques and to provide golf balls having considerably improved aerodynamic isotrophy by making the total number of particular great circles regularly existing in the ball larger to increase the number of center axes or symmetrical axes.

According to the invention, there is the provision of a golf ball having a spherical surface inscribed or circumscribed with a regular icosahedron and a plurality of dimples formed in the spherical surface, characterized in that said ball includes at least three groups of great circles. A first group is composed of a great circle including each side of each of spherical triangles formed by projecting regular triangles constituting said regular icosahedron onto said spherical surface and a great circle including a line segment drawn from a midpoint of said side to its diagonal point. A second group is composed of a great circle including a line segment drawn from a midpoint of a side in the spherical triangle to another midpoint of another side thereof. A third group is composed of a great circle including a line segment obtained by projecting a normal line drawn from a midpoint of each side of said regular triangle to its opposed side thereof onto said spherical surface, each great circle of which groups being not crossed with the dimples.

In this golf ball, the shape of the dimple is not necessarily restricted to circle. Further, the term "aerodynamic isotropy" used herein means that even when the striking position of the golf ball is changed, the lifting force and resistance force of the struck ball are not changeable and hence the flying directionality and driving distance of the ball are not changed even in the changing of the striking position.

DESCRIPTION OF THE PREFERRED EMBODIMENTS

In the golf ball according to the invention, the first group composed of a great circle including each side of the spherical triangle and a great circle including a line segment drawn from a midpoint of each side of the spherical triangle to its diagonal point has 15 great circles in total formed about a line segment passing from the midpoint of each side of the spherical triangle to the center of the sphere as a center axis. The second group composed of a great circle including a line segment drawn from a midpoint of a side in the spherical triangle to another midpoint of another side thereof has 6 great circles in total formed about a line segment passing from each vertex of the spherical triangle to the center of the sphere as a center axis. The third group composed of a great circle including a line segment formed by projecting a normal line drawn from a midpoint of each side of the regular triangle to its opposite side thereof onto the spherical surface has 10 great circles in total formed about a line segment passing from the center of the spherical triangle to the center of the sphere as a center axis.

Therefore, the golf ball according to the invention has at least two groups among the above three groups, so that the total number of regularlly existing great circles can be set to not less than 16, and consequently the probability of rotating the ball in the extending direction of the great circle may become considerably higher as compared with the conventional techniques. As a result, the aerodynamic isotoropy of the golf ball is considerably improved and the driving performances such as flying directionality, driving distance and so on become stable irrespective of the striking position on the golf ball because the golf ball is substantially affected by uniform aerodynamic action at both sides with respect to the great circle.

Figure 1:
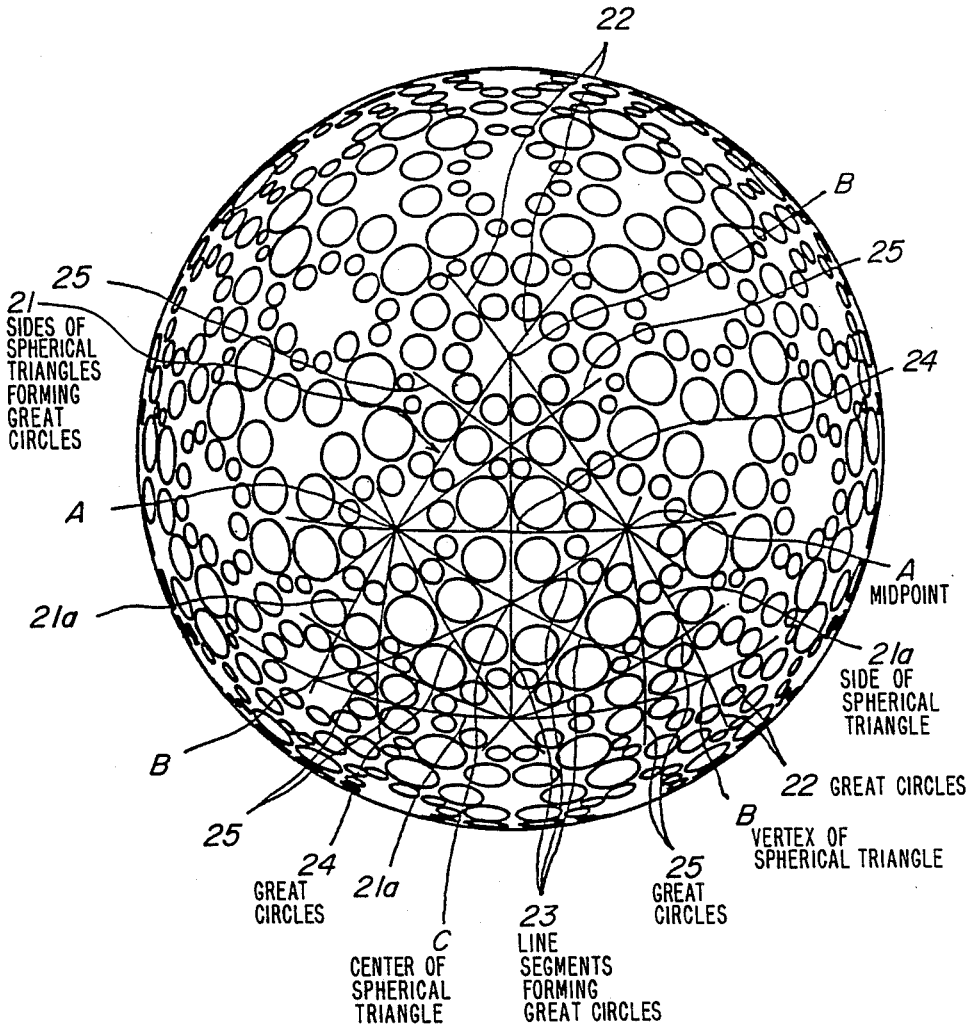
FIGS. 1 to 4 are elevational views of some embodiments of the golf ball according to the invention.

In FIG. 1 is shown an elevational view of a preferred embodiment of the golf ball according to the invention. In each of spherical triangles 21 formed by projecting each of regular triangles constituting a regular icosahedron onto the spherical surface of the illustrated golf ball, a first group composed of a great circle 22 including each side of the spherical triangle 21 and a great circle 23 including a line segment drawn from a midpoint A of the side to its diagonal point is depicted on the spherical surface about a line segment passing from the midpoint A of each side 21*a* of the spherical triangle 21 to the center of the sphere as a center axis. Dimples are arranged so as to be symmetrical with respect to each of the great circles 22 and 23. Further, a second group composed of a great circle 24 including a line segment drawn from a midpoint A of a side 21*a* in the spherical triangle 21 to another midpoint of another side thereof is depicted about a line segment passing from each of vertexes B of the spherical triangle 21 to the center of the sphere as a center axis so as not to cross with the dimples. Moreover, a third group composed of a great circle 25 including a line segment obtained by projecting a normal line drawn from a midpoint of each side of the regular triangle to its opposed side thereof onto the spherical surface is depicted about a line segment passing from a center C of the spherical triangle 21 to the center of the sphere as a center axis so as not to cross with the dimples. Therefore, the illustrated golf ball has thirty one great circles in total, so that the aerodynamic isotropy is considerably improved as compared with conventional golf balls.

Figure 2:
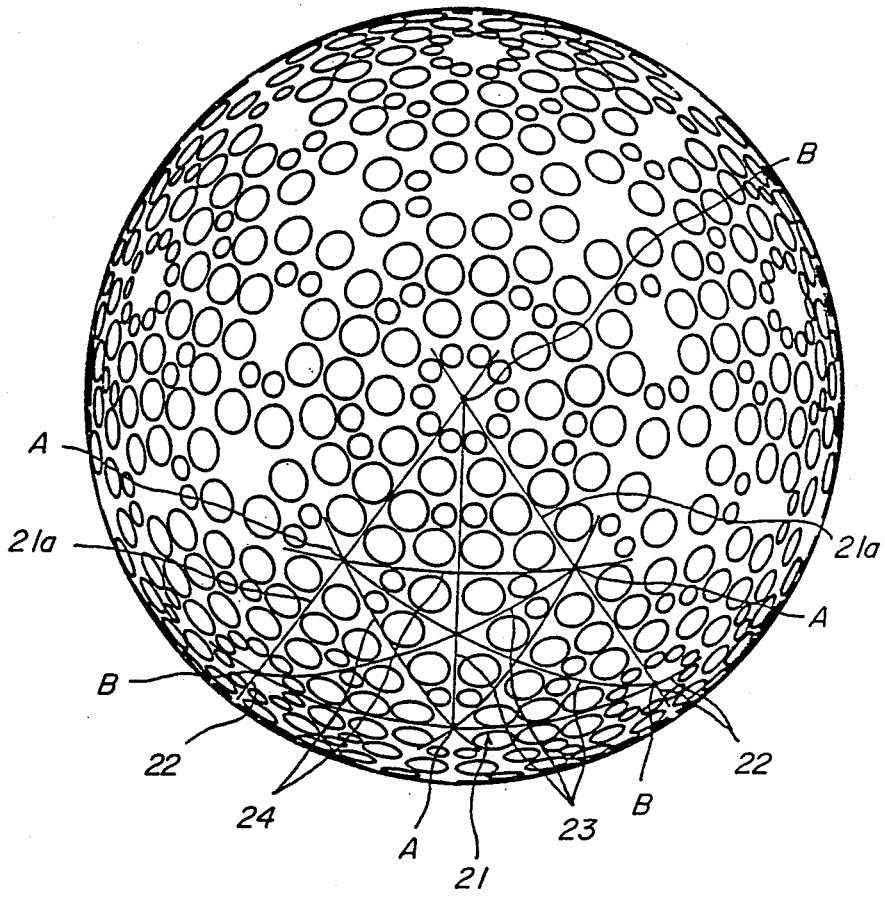
Figure 3:
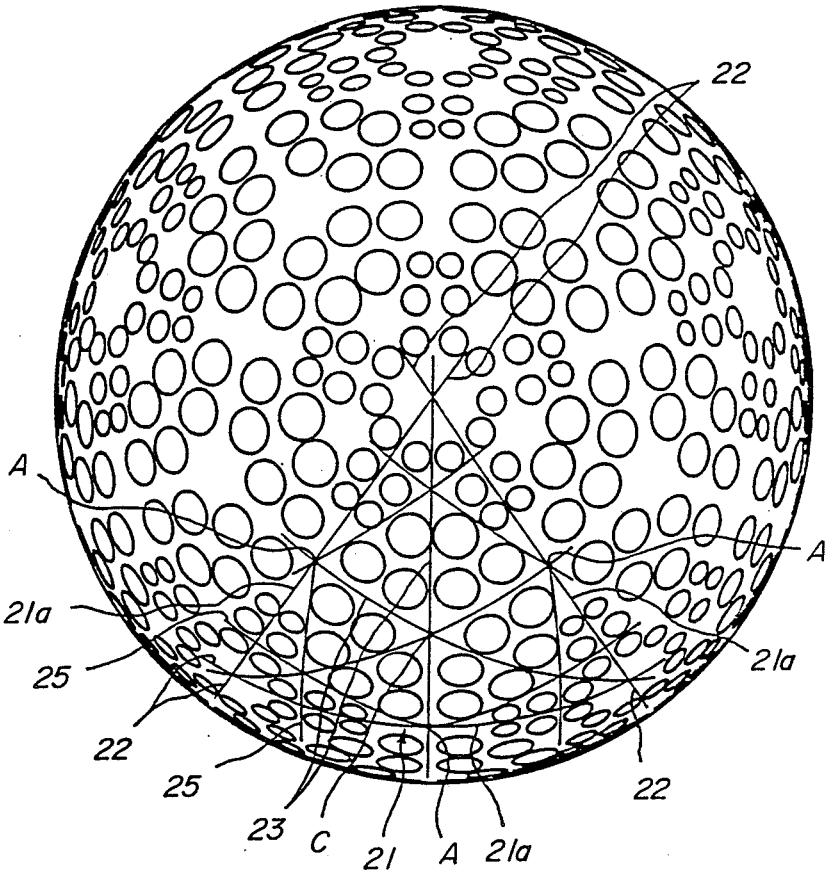
Figure 5A:
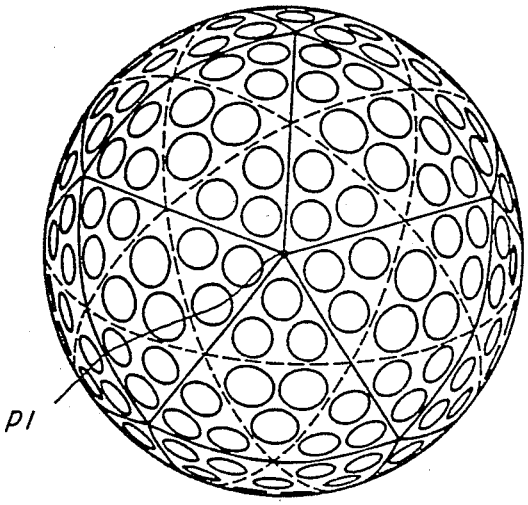
FIG 5a PRIOR ART
FIGS. 5*a* and 5*b* are elevational views of the conventional golf balls, respectively.
Figure 5B:
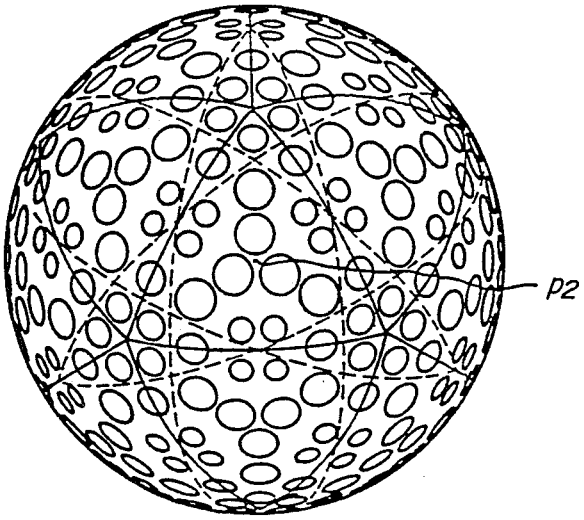
FIG 5b PRIOR ART
Figure 4:
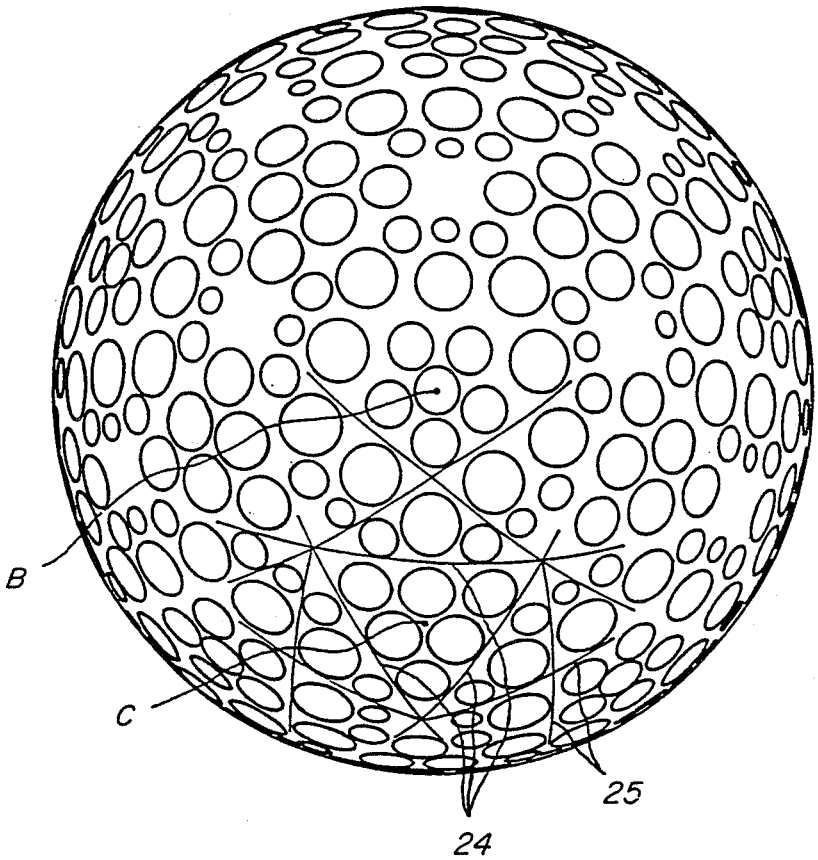

In FIGS. 2 to 4 are shown elevational views of other embodiments of the golf ball according to the invention, respectively. In the golf ball of FIG. 2, a line segment passing from a midpoint A of each side of the spherical triangle 21 to the center of the sphere and a line segment passing from each vertex B of the spherical triangle 21 to the center of the sphere are selected as a center axis, respectively, so that the same great circles 22, 23 and 24 as in the first embodiment are depicted on the spherical surface. In this case, the dimples are arranged so as to be symmetrical with respect to each of the great circles 22, 23, while the great circle 24 extends so as not to cross with the dimples. In the second embodiment, the number of great circles 22, 23, 24 is twenty one in total.

In the embodiment of FIG. 3, the line segment connecting the midpoint A of each side 21*a* of the spherical triangle to the center of the sphere is a symmetrical axis and the great circle is formed about this symmetrical axis, so that the number of great circles 22, 23, 25 is twenty five in total.

In the embodiment of FIG. 4, the number of great circles 24, 25 is sixteen in total.

According to the invention, the total number of great circles is considerably increased as compared with that of the conventional technique as mentioned above, resulting in the considerable improvement of aerodynamic isotropy.

Although the shape in flat section of the dimple is circular in the illustrated embodiments, it is a matter of course that the dimple may take a polygonal shape such as triangle, tetragon, pentagon, hexagon or the like, or a combination of circular shape and polygonal shape. As illustrated the dimples are circular and have different circumferences. Further, the dimple arrangement according to the invention is preferably applied to all kind of golf balls.

In the golf balls according to the invention, it has been confirmed that even when the ball is struck at any positions by means of a strike testing machine, the flying directionality of the struck ball is accurate and the driving distance thereof is increased as compared with the conventional balls. Further, since the golf ball according to the invention has at least 16 symmetrical axes, when the ball is laid on a tee or on ground, the flying directionality and driving distance can accurately be controlled. Therefore, the presence of the mold parting line does not affect the flying performance of the golf ball.

As mentioned above, the golf balls according to the invention has at least sixteen great circles or symmetrical axes, so that the aerodynamic isotropy is considerably be improved as compared with the conventional golf balls, and the scattering of flight performances can effectively reduced.

What is claimed is:

1. A golf ball comprising; a spherical surface inscribed or circumscribed with a regular icosahedron and dimples formed in the spherical surface, groups of great circles, a first group composed of great circles (22) including each side of spherical triangles (21) formed by projecting regular triangles constituting said regular icosahedron onto said spherical surface, great circles (23) including a line segment drawn from a midpoint (A) of said side of said spherical triangles to its diagonal point, a second group composed of great circles (24) including a line segment drawn from a midpoint of a side in the spherical triangle to another midpont of another side thereof, and a third group composed of great circles (25) including a line segment obtained by projecting a line drawn from a midpoint of each side of said regular triangle and normal thereto to its opposed side thereof onto said spherical surface, each great circle of said groups not crossing over the dimples.

2. The golf ball according to claim 1, wherein said first group has 15 great circles in total.

3. The golf ball according to claim 1, wherein said second group has 6 great circles in total.

4. The golf ball according to claim 1, wherein said third group has 10 great circles in total.

* * * * *